US007325426B1

(12) United States Patent
Kuo

(10) Patent No.: US 7,325,426 B1
(45) Date of Patent: Feb. 5, 2008

(54) SAFE ELECTROMAGNETIC LOCK

(76) Inventor: Ching-Hung Kuo, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 11/490,040

(22) Filed: Jul. 21, 2006

(51) Int. Cl.
*E05B 47/00* (2006.01)
*E05B 49/00* (2006.01)
*E05B 35/08* (2006.01)

(52) U.S. Cl. ..... 70/337; 70/278.1; 70/278.2; 70/277

(58) Field of Classification Search ..... 70/337, 70/278.1, 278.2, 279.1, DIG. 63, 277
See application file for complete search history.

(56) References Cited

U.S. PATENT DOCUMENTS 2,524,696 A * 10/1950 Ellis ..... 70/339
3,837,196 A * 9/1974 Gartner et al. ..... 70/339
4,262,504 A * 4/1981 Inoue ..... 70/151 R
5,495,733 A * 3/1996 Yen et al. ..... 70/278.3
5,701,828 A * 12/1997 Benore et al. ..... 109/56
6,612,142 B1 * 9/2003 Capwell ..... 70/355

* cited by examiner

*Primary Examiner*—Carlos Lugo
*Assistant Examiner*—Kristina R Gluchowski
(74) *Attorney, Agent, or Firm*—Troxell Law Office, PLLC

(57) ABSTRACT

A safe electromagnetic lock including a first bolt provided with an elastic fastener, an elastic slide bolt positioned on an end of the first bolt, an electromagnetic device connected to a computer and a second bolt. The computer controls induction of the elastic fastener by the electromagnetic device, and a key inserted into a first keyhole, or another key inserted into a second keyhole, controls sliding movement of the elastic slide block to push against the elastic fastener, thereby releasing an abutting state and effecting unhindered unlocking of the safe electromagnetic lock. Upon unlocking, a front end of the second bolt extends out from a case, and protruding mount of the second bolt is used to press down on a steel ball, thereby enabling the second bolt to achieve a solid fixation and effectively preventing mistakenly locking and avoiding forgetting to lock the safe electromagnetic lock.

4 Claims, 7 Drawing Sheets

SAFE ELECTROMAGNETIC LOCK

BACKGROUND OF THE INVENTION (a) Field of the Invention

The present invention relates to a safe electromagnetic lock, and more particularly to a safe electromagnetic lock that has safety features and is convenient to operate, which is structured so as to use a computer to control an electromagnetic device to release an abutting state, and in combination with a key inserted into a first keyhole the safe electromagnetic lock is thus able to be to unlocked. Moreover, another key can be inserted into a second keyhole to release the abutting state and thus unlock the safe electromagnetic lock. After unlocking, a second bolt is used to form a solid fixation, thereby effectively preventing mistakenly locking and avoiding forgetting to lock the safe electromagnetic lock.

(b) Description of the Prior Art

In order to achieve the objective to prevent illegal opening while at the same time being provided with confidentiality and convenience of opening, locksets used in traditional vaults and safes are all designed with two keys that are respectively inserted into two keyholes located at different positions on the lockset, and which are used to simultaneously actuate lock core devices within the lockset. Although such locksets provide a measure of safety, however, the lock core devices must be installed within the lockset so as to afford mutually concatenated movement. Hence, it is not possible to reduce the size of such locksets; moreover, shortcomings familiar in such types of locksets of prior art include relatively complicated internal mechanisms, high cost of manufacture, inconvenient to repair after damage, and so on.

Another type of prior art lockset is an electromagnetic lock that is connected to a computer, which uses the input of a password to activate an electromagnetic device that induces fastening members within the lockset, whereby, in combination with keys, unlocking of the electromagnetic lock is enabled. Although such electromagnetic locks have the advantages of being small in size, and are provided with a simple mechanism and a high degree of safety, however, such electromagnetic locks are limited to electromagnetic devices, and easily cause safety concerns, for example, a computer system crashing, malfunctioning or a temporary power cut results in being unable to operate the computer, and thus unable to freely unlock the electromagnetic lock.

Furthermore, the majority of both traditional mechanical locks and electromagnetic locks have installed a second bolt, the freely retractable characteristic of which is used to prevent mistakenly locking and avoid forgetting to lock the mechanical lock or the electromagnetic lock. However, the freely retractable movement of the aforementioned second bolt mechanism as seen in prior art results in poor functionality to prevent mistakenly locking a door of a vault or safe. Moreover, a user is unable to detect whether or not the door is really locked after closing the door, thereby causing inconvenience when operating the prior art locksets.

SUMMARY OF THE INVENTION

In light of the aforementioned, the present invention provides a safe electromagnetic lock that is able to effectively improve upon the aforesaid shortcomings and inconvenience of prior art.

Accordingly, a primary objective of the present invention is to provide the safe electromagnetic lock with a configuration that has safety features and is convenient to operate that uses a computer to control an electromagnetic device to release an abutting state, or another key can be inserted into a second keyhole to release the abutting state, and in combination with a key inserted into a first keyhole the safe electromagnetic lock is thus able to be to unlocked.

Another objective of the present invention is to provide the safe electromagnetic lock with substantially increased safety by using a protruding mount of a second bolt, which has extended outwards from a case after unlocking, to press down on a steel ball, thereby solidly fixing position of the second bolt, and ensuring the effective prevention of mistakenly locking and avoiding forgetting to lock the safe electromagnetic lock.

In order to achieve the aforementioned objectives, the present invention adopts the following technical proposals.

The safe electromagnetic lock of the present invention is structured to comprise the first bolt having an elastic fastener, an elastic slide block located on an end of the first bolt, an electromagnetic device connected to a computer and the second bolt, all of which are installed within a case of the electromagnetic lock.

A key inserted into the first keyhole can control the aforementioned first bolt in extending from or retracting within the case.

The first bolt comprises an extended section, on an end of which is located the elastic fastener. The elastic fastener abuts against a protruding edge of the case, thereby disabling the first bolt from arbitrarily retracting inward and preventing unlocking of the safe electromagnetic lock.

The aforementioned elastic slide block is located within the case on a bottom end of the extended section of the first bolt. Another key inserted into the second keyhole is able to control sliding movement of the elastic slide block on the bottom end of the extended section.

The elastic slide block comprises a spring that is disposed between an end surface of the elastic slide block and an inner wall of the case. A contact end is formed on the elastic slide block positioned at another end surface of the bottom end of the extended section of the first bolt. When the other key is inserted into the second keyhole to control sliding movement of the elastic slide block, then the contact end is made to push against the elastic fastener, thereby releasing the abutting state between the elastic fastener and the protruding edge of the case.

An induction surface of the aforementioned electromagnetic device positioned within the case at an upper end of the extended section of the first bolt fittingly reciprocates the aforementioned elastic fastener. When the electromagnetic device is connected to the computer using conducting wires, the electromagnetic device is activated when a correct password is input into the computer, whereupon electromagnetic induction moves the elastic fastener, thereby releasing the abutting state between the elastic fastener and the protruding edge of the case.

The aforementioned second bolt is positioned within the case above the first bolt, and comprises a spring fitted thereon, which is used to provide the second bolt with outward extending elasticity, and a steel ball disposed between the first bolt and the second bolt.

According to the aforementioned structural configuration, when it is desired to unlock the safe electromagnetic lock, computer control of the electromagnetic device enables inducing the elastic fastener to release the abutting state, and inserting the key into the first keyhole enables controlling retracting movement of the first bolt, thereby unlocking the safe electromagnetic lock or, should the computer system crash, malfunction or there is a temporary power cut, resulting in being unable to operate the computer, then the other key can be inserted into the second keyhole to control the elastic slide block and cause a sliding movement of the elastic slide block away from pushing against the elastic fastener, thereby releasing the abutting state, which, combined with inserting the key into the first keyhole, controls the retracting movement of the first bolt, thereby enabling unhindered unlocking of the safe electromagnetic lock, and providing the present invention with convenient operation.

After unlocking, the front end of the second bolt extends out from the case, whereupon the protruding mount of the second bolt is used to press down on the steel ball, thereby solidly fixing position of the second bolt, and ensuring the effective prevention of mistakenly locking and avoiding forgetting to lock the safe electromagnetic lock, thus providing the present invention with convenient operation.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
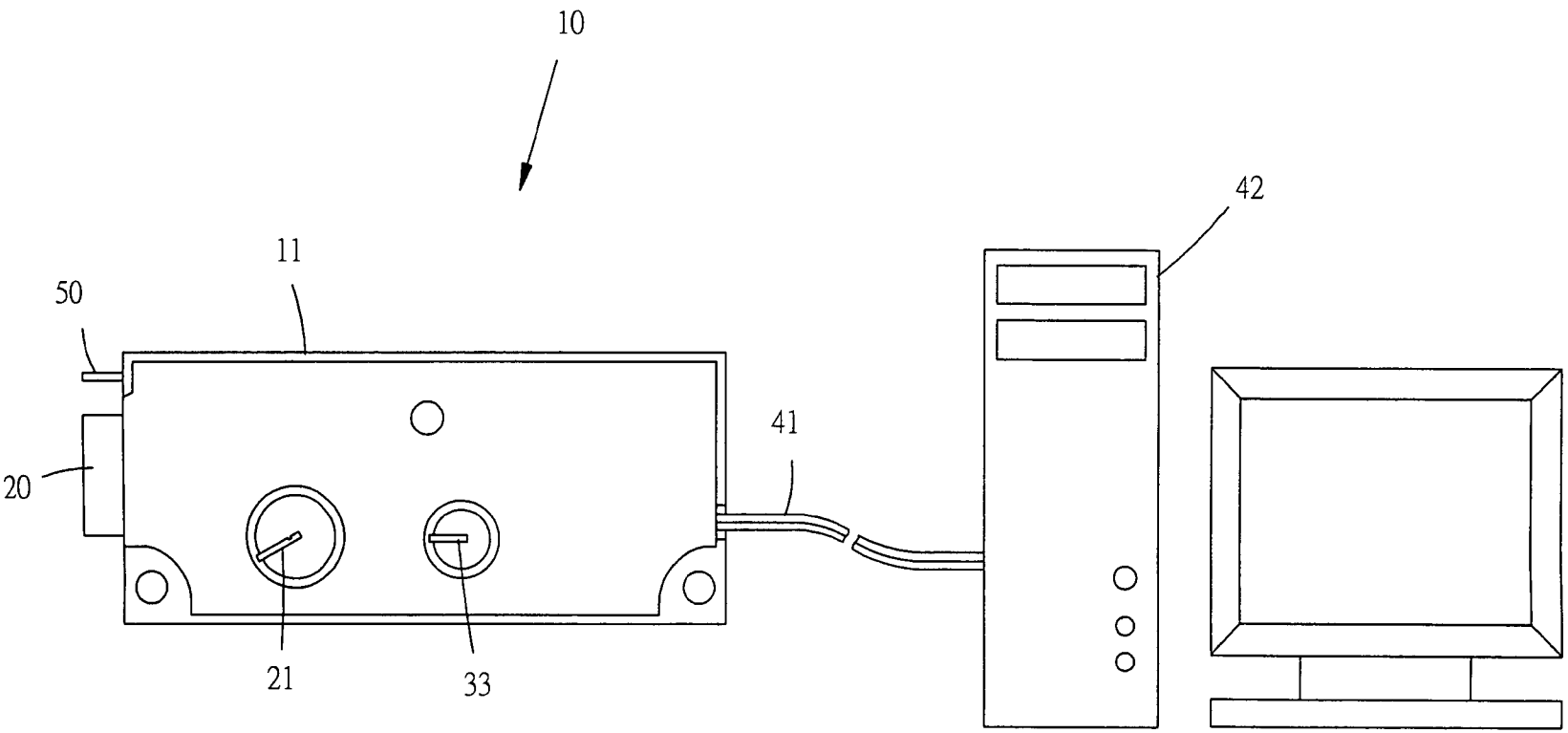
FIG. 1 shows a schematic view of a safe electromagnetic lock connected to a computer according to the present invention.
Figure 2:
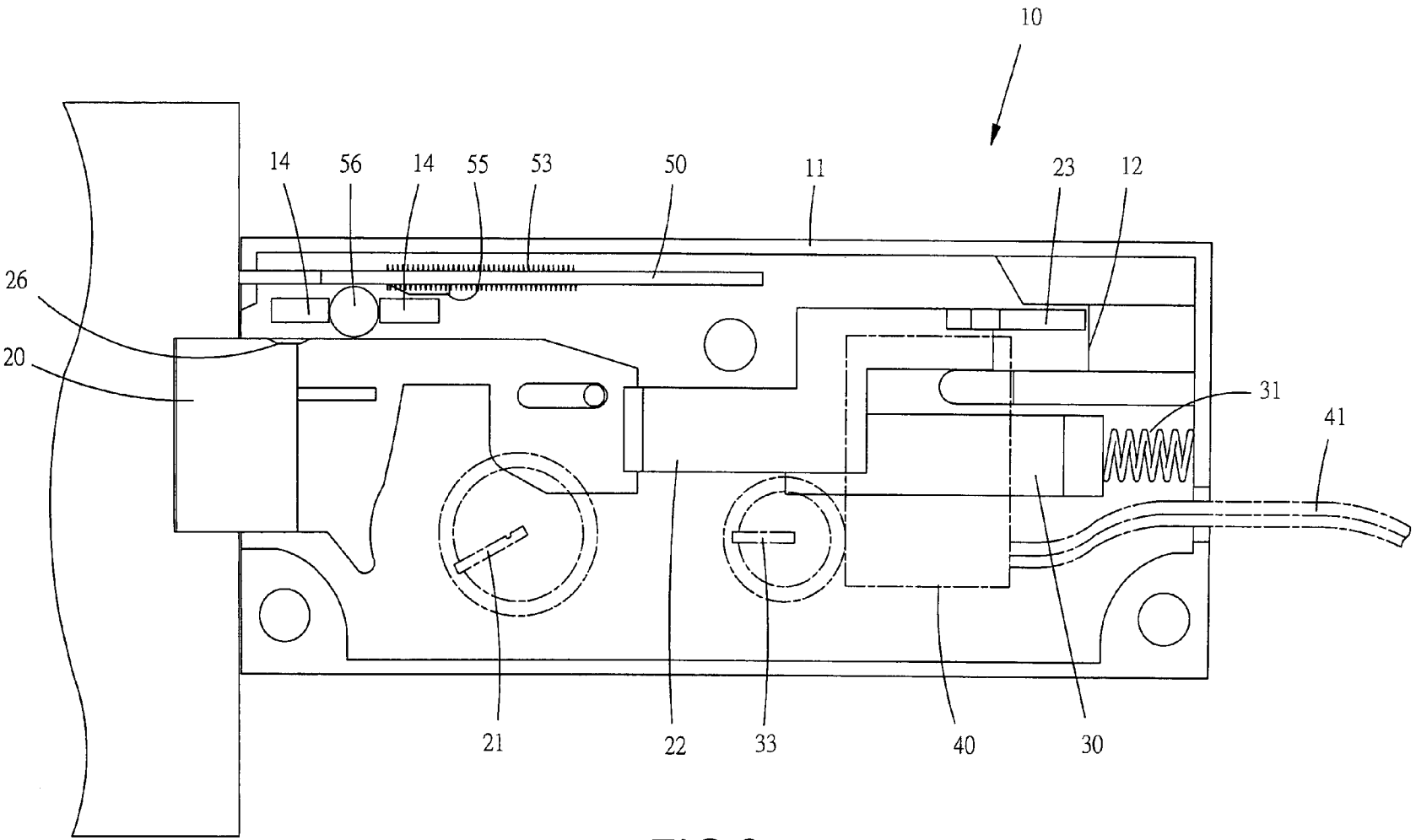
FIG. 2 shows a plan view of component members within the safe electromagnetic lock depicting a locked state, wherein a first bolt is fastened within a lockhole, and a second bolt is retracted within a case according to the present invention.

Referring to FIG. 1, which shows a schematic view of a safe electromagnetic lock 10 of the present invention connected to a computer 42. Referring to FIG. 2, which shows a plan view of component members within the safe electromagnetic lock 10 depicting a locked state according to the present invention, wherein an outwardly extended first bolt 20 is fastened within a lockhole, and a second bolt 50 is inwardly retracted within a case 11.

Referring to FIGS. 1 and 2, which show the safe electromagnetic lock 10 of the present invention structured to comprise the first bolt 20 having an elastic fastener 23, an elastic slide block 30 located on an end of the first bolt 20, an electromagnetic device 40 connected to the computer 42 and a second bolt 50, all of which are installed within the case 11 of the electromagnetic lock 10.

Figure 3:
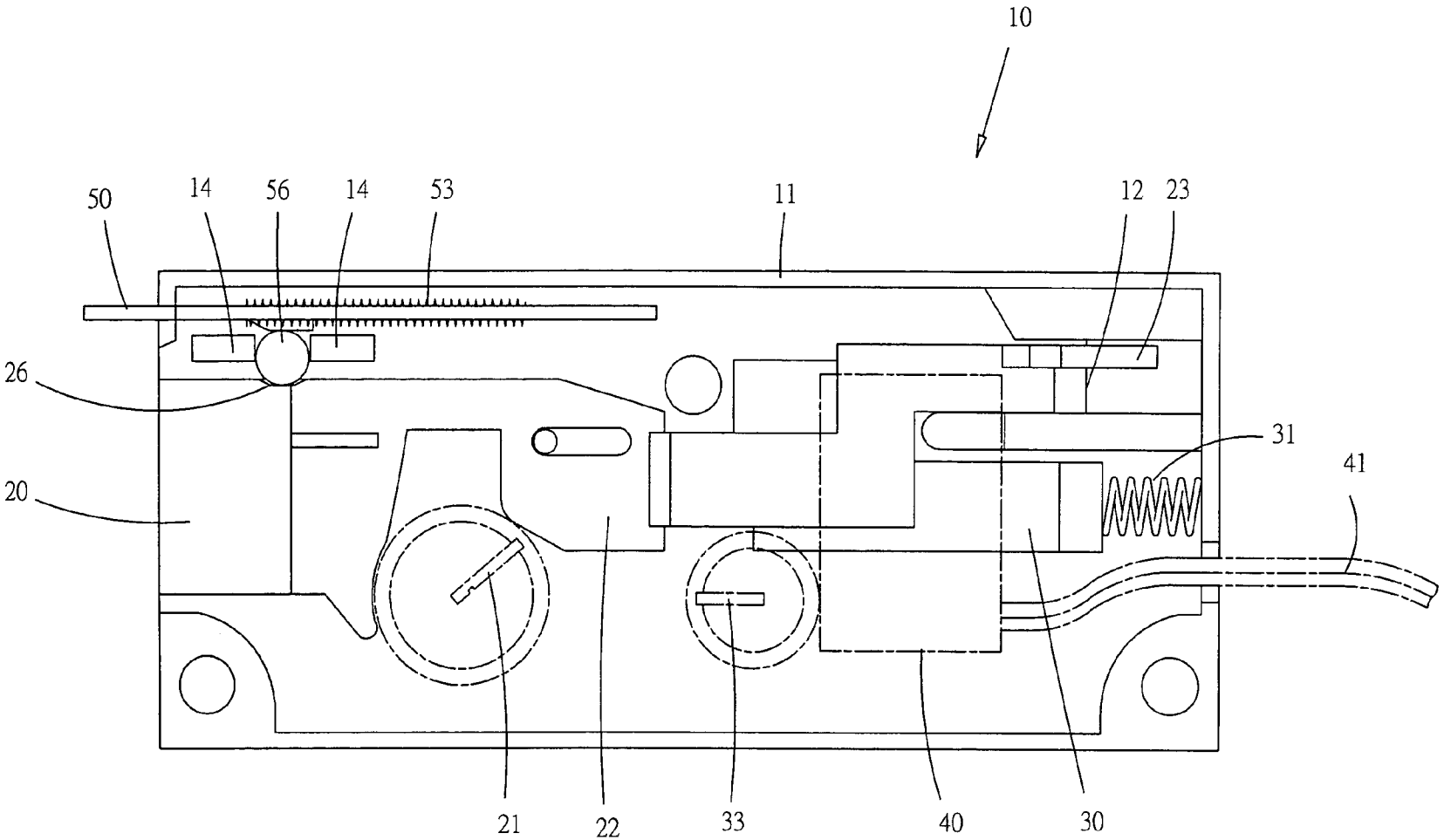
FIG. 3 shows a plan view of the component members within the safe electromagnetic lock depicting an unlocked state, wherein the first bolt is retracted within the case, and a front end of the second bolt is extending out the case according to the present invention.

Referring to FIG. 3, which shows a plan view of the component members within the safe electromagnetic lock 10 depicting an unlocked state according to the present invention, wherein the first bolt 20 is inwardly retracted within the case 11, and a front end of the second bolt 50 outwardly extends from the case 11.

Figure 4:
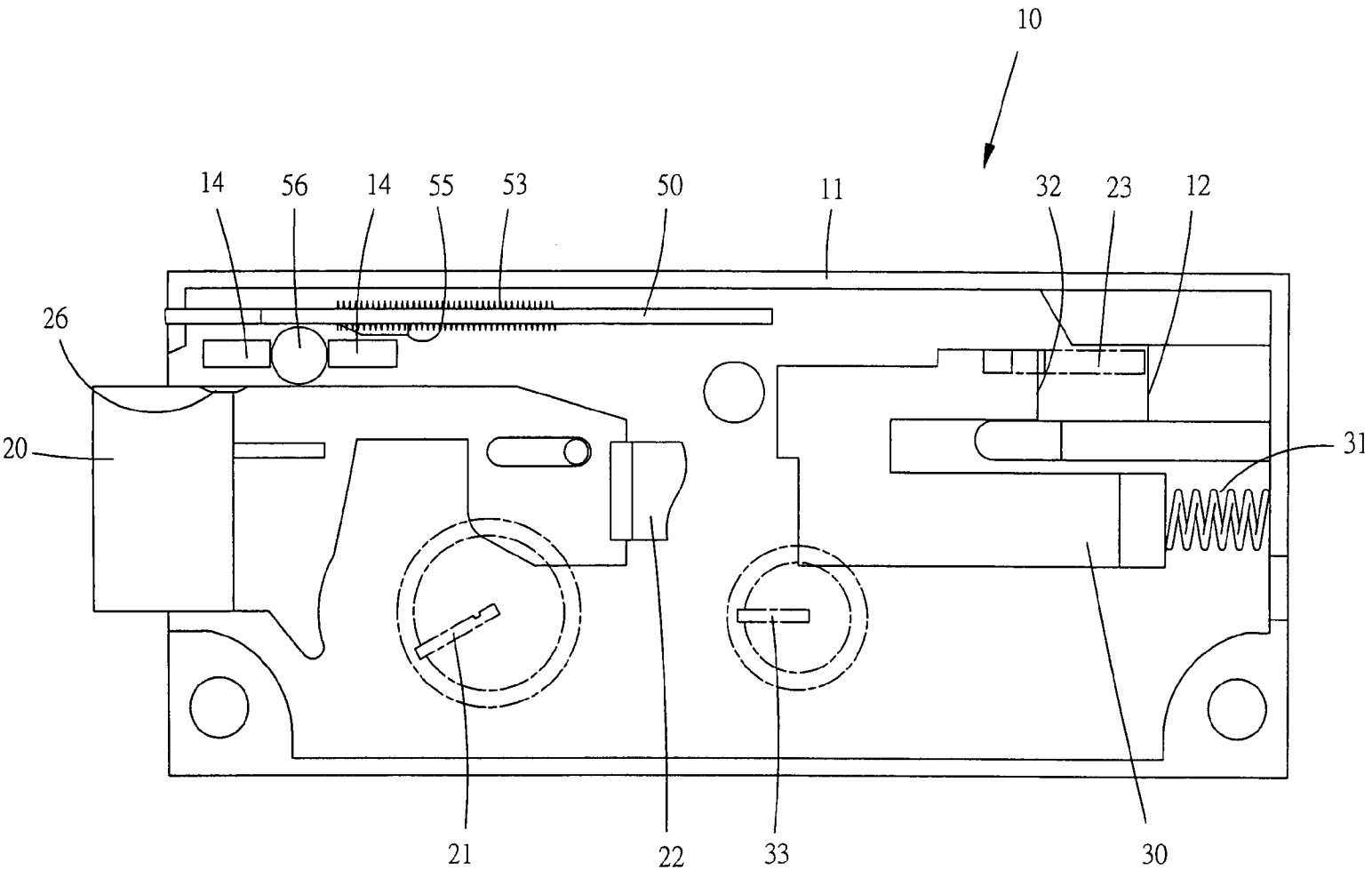
FIG. 4 shows a plan view of the component members within the safe electromagnetic lock, wherein an electromagnetic device has been dismantled, and depicts an elastic slide block of an extended section of the first bolt according to the present invention.

Referring to FIG. 4, which shows a plan view of the component members within the safe electromagnetic lock 10 of the present invention, wherein the electromagnetic device 40 has been dismantled and depicts the elastic slide block 30 located at a bottom end of an extended section 22 of the first bolt 20.

Referring to FIGS. 2 and 3, a first key is inserted into a first keyhole 21 on the case 11 to control outward extending from or inward retracting into the case 11 of the first bolt 20.

The first bolt 20 comprises the extended section 22, on an end of which is disposed the elastic fastener 23. The elastic fastener 23 is able to abut against a protruding edge 12 of the case 11, thereby disabling the first bolt 20 from arbitrarily retracting inward and preventing unlocking of the safe electromagnetic lock 10.

Figure 5:
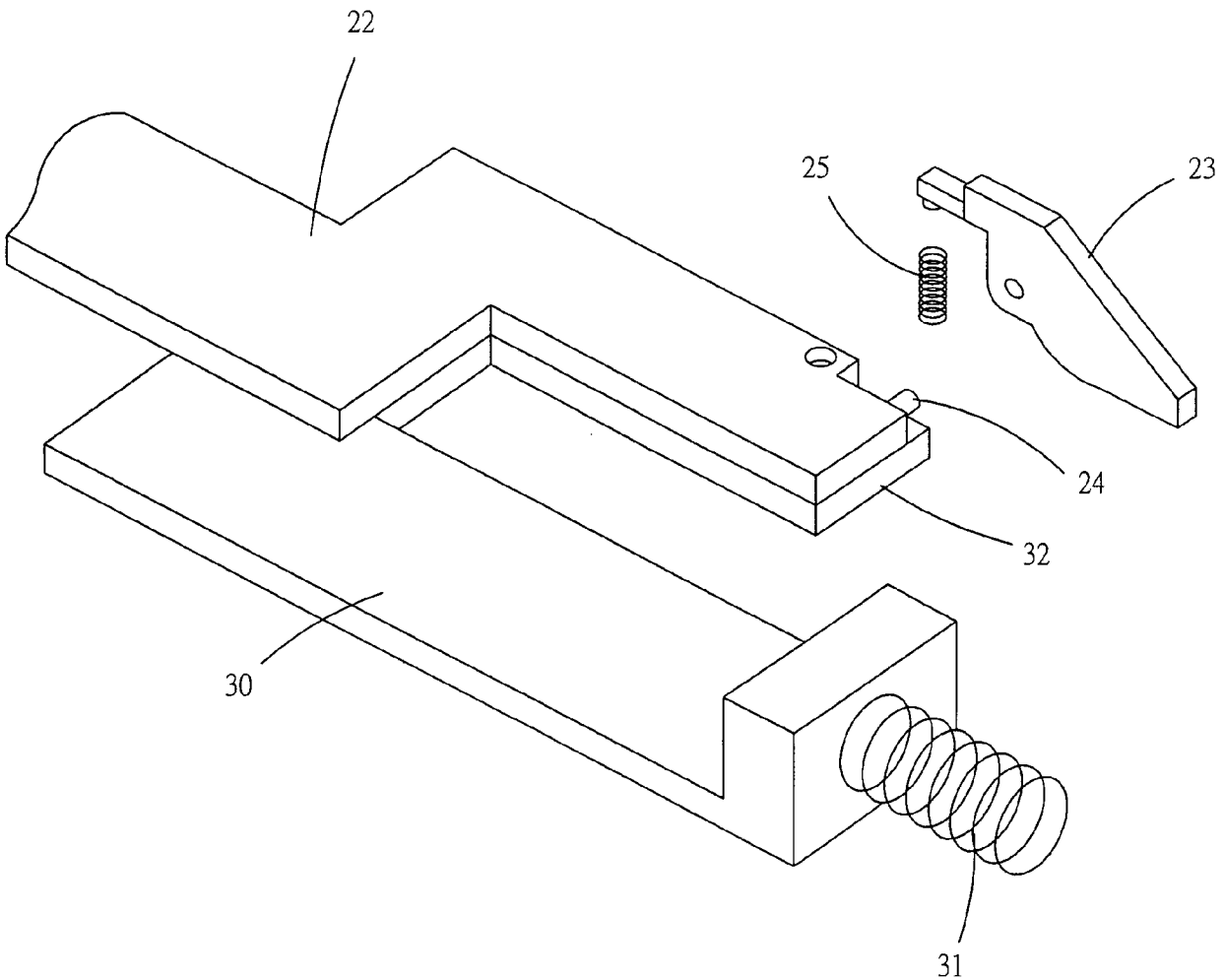
FIG. 5 shows an exploded structural view depicting an elastic fastener located at an end of the extended section of the first bolt of the safe electromagnetic lock according to the present invention.

FIG. 5 shows an exploded structural view of the elastic fastener 23 at the end of the extended section 22 of the first bolt 20 of the safe electromagnetic lock 10 of the present invention.

Figure 6:
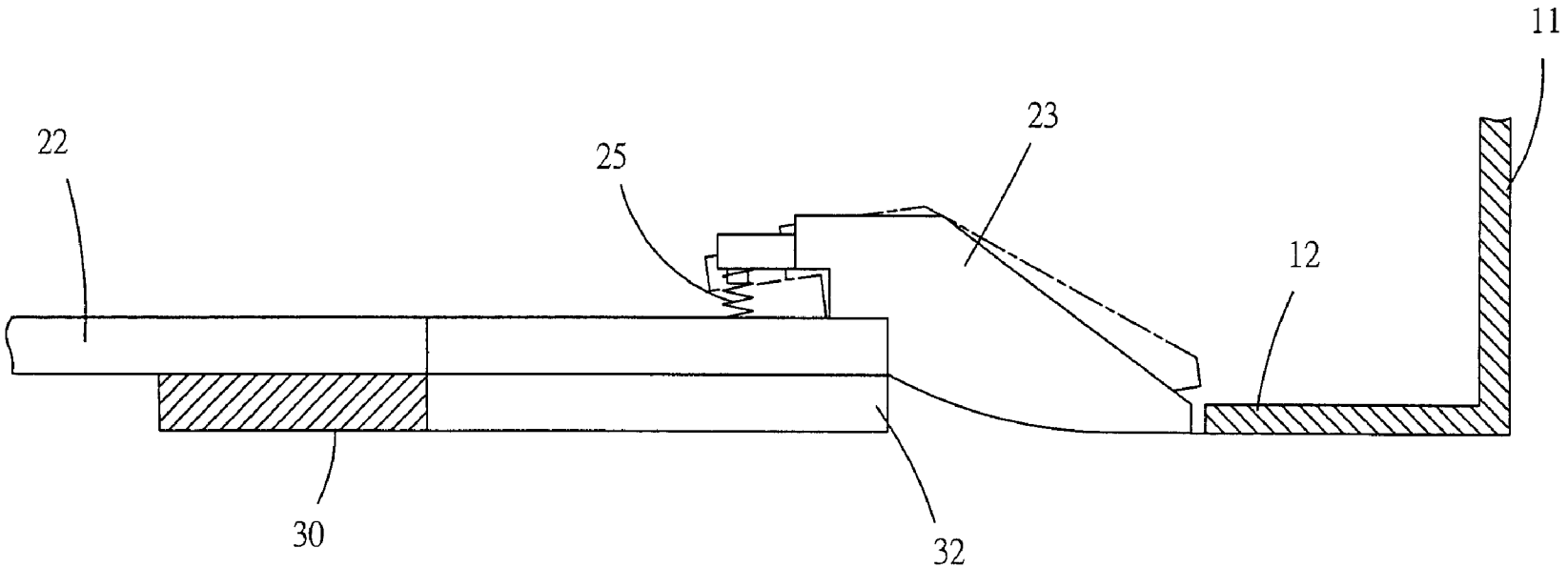
FIG. 6 shows a schematic view depicting movement of the elastic fastener located at the end of the extended section of the first bolt of the safe electromagnetic lock according to the present invention.

FIG. 6 shows a schematic view depicting movement of the elastic fastener 23 at the end of the extended section 22 of the first bolt 20 of the safe electromagnetic lock 10 according to the present invention. Referring to FIG. 5, a pivot shaft 24 is pivotally located at the end of the extended section 22 of the first bolt 20, and a spring 25 is disposed between the aforementioned elastic fastener 23 and the end of the extended section 22. A front end of the elastic fastener 23 is forced downward when subjected to elastic tension, thereby causing the elastic fastener 23 to abut against the protruding edge 12 of the case 11, as depicted in FIG. 6 and FIG. 2, and disabling the first bolt 20 from arbitrarily retracting inward, thus preventing unlocking of the safe electromagnetic lock 10.

Referring again to FIG. 4, another key is inserted into a second keyhole 33 on the case 11 to control sliding movement of the aforementioned elastic slide block 30 located at a bottom end of the extended section 22 of the first bolt 20 within the case 11.

Referring to FIGS. 4 and 5, the elastic slide block 30 comprises a spring 31 that is disposed between an end surface of the elastic slide block 30 and an inner wall of the case 11. The elastic slide block 30 is positioned at another end surface of the bottom end of the extended section 22 of the first bolt 20. The other key can be inserted into the second keyhole 33 to control sliding movement of the elastic slide block 30 whereby a contact end 32 can be caused to push against the elastic fastener 23 (see the elastic fastener depicted by a dotted line in FIG. 6), thereby releasing the abutting state between the elastic fastener 23 and the protruding edge 12 of the case 11.

Referring to FIGS. 1 and 2, an induction surface of the aforementioned electromagnetic device 40 positioned within the case 11 at an upper end of the extended section 22 of the first bolt 20 fittingly reciprocates the aforementioned elastic fastener 23. The electromagnetic device 40 is connected to the computer 42 using conducting wires 41, and the electromagnetic device 40 is activated when a correct password is input into the computer 42, whereupon electromagnetic induction moves the elastic fastener 23 (see the elastic fastener 23 depicted by a dotted line in FIG. 6), thereby releasing the abutting state between the elastic fastener 23 and the protruding edge 12 of the case 11.

Accordingly, when it is desired to unlock the safe electromagnetic lock 10, the correct password must first be input into the computer 42 which controls the electromagnetic device 40 within the case 11, thereby inducing the elastic fastener 23 to release the abutting state, which, combined with inserting the key into the first keyhole 21, controls retracting movement of the first bolt 20, thereby enabling unhindered unlocking of the safe electromagnetic lock 10.

Should the computer system crash, malfunction or there is a temporary power cut, resulting in being unable to operate the computer 42, then the other key can be inserted into the second keyhole 33 to control the elastic slide block 30 compressing the spring 31 and cause a sliding movement of the elastic slide block 30 away from pushing against the elastic fastener 23, thereby releasing the abutting state, which, combined with inserting the key into the first keyhole 21, controls the retracting movement of the first bolt 20, thereby enabling unhindered unlocking of the safe electromagnetic lock 10.

Figure 7:
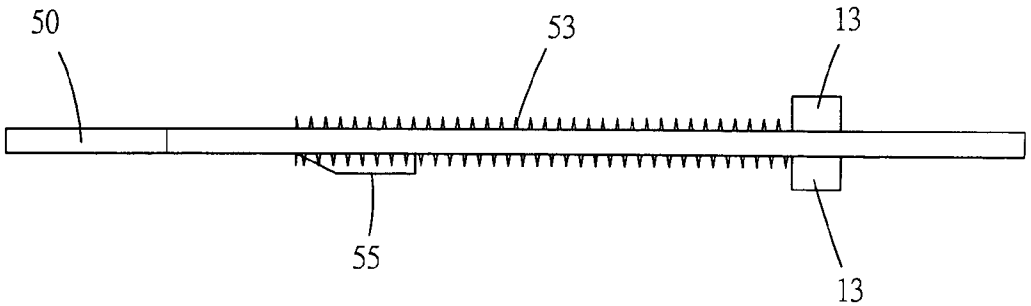
FIG. 7 shows a top view of the second bolt of the safe electromagnetic lock of the present invention.

FIG. 7 shows a top view of the second bolt 50 of the safe electromagnetic lock 10 of the present invention.

Figure 8:
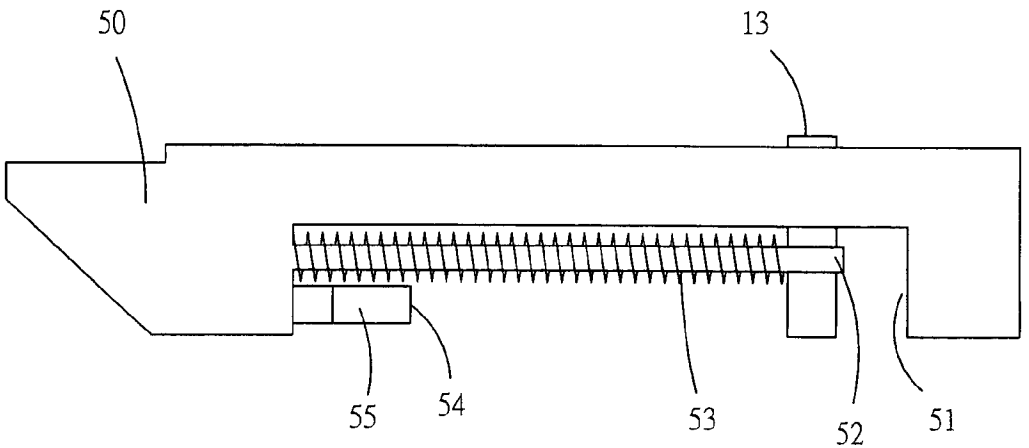
FIG. 8 shows a side view of the second bolt of the safe electromagnetic lock of the present invention.

FIG. 8 shows a side view of the second bolt 50 of the safe electromagnetic lock 10 of the present invention.

Referring to FIGS. 2, 3 and FIGS. 7, 8, the aforementioned second bolt 50 is located within the case 11 above the first bolt 20. When locking the safe electromagnetic lock 10, the first bolt 20 extends into the lockhole, and the second bolt 50 inwardly retracts within the case 11, as depicted in FIG. 2. When unlocking the safe electromagnetic lock 10, the first bolt 20 retracts within the case 11, and the second bolt 50 extends out from the case 11, as depicted in FIG. 3. The freely retractable characteristic of the second bolt 50 is used to prevent mistakenly locking the safe electromagnetic lock 10.

A recess 51 is formed in a bottom edge of the second bolt 50, as depicted in FIG. 8, and a first cross bar 52 and a second cross bar 54 are located within the recess 51. A spring 53 is fitted on the first cross bar 52, and a protruding mount 55 protrudes from a side end surface of the second cross bar 54, A steel ball 56, as depicted in FIG. 2, is positioned between the first bolt 20 and the second bolt 50 within a space between two protruding mounts 14 protruding from a bottom edge of the case 11.

After assembling the second bolt 50, the elastic spring 53 causes the second bolt 50 to outwardly extend. When unlocking, the second bolt 50 automatically extends outward, as depicted in FIG. 3, at which time the outward extending second bolt 50 squeezes the steel ball 56 downward by means of the protruding mount 55 of the second cross bar 54, thereby causing the steel ball 56 to become positionally fixed in an indentation 26 predefined on the first bolt 20.

Regarding configuration, because protruding thickness of the protruding mount 55 is greater than cavity depth of the indentation 26, thus, the outward extending action of the aforementioned second bolt 50 presses the steel ball 56 downward and substantially fixes position of the steel ball 56 thereat, thereby preventing the second bolt 50 from readily retracting within the case 11, thus effectively forbidding mistakenly locking and avoiding forgetting to lock the safe electromagnetic lock 10.

When locking the safe electromagnetic lock 10, a pushing force when closing the door of a vault or safe is used to cause the second bolt 50 to retract within the case 11, at which time the protruding mount 55 moves inward and separates from the steel ball 56, thereby releasing the aforementioned compressed state of the steel ball 56, as depicted in FIG. 2, whereupon the key is inserted within the first keyhole 21, which actuates the first bolt 20 to freely extend outward and into the lockhole, thereby completing locking of the safe electromagnetic lock 10.

According to the aforementioned disclosures, unhindered unlocking of the safe electromagnetic lock 10 of the present invention requires combining the mechanical first bolt 20 with the electromagnetic device 40. If the electromagnetic device 40 malfunctions, then use of the mechanical first bolt 20 in combination with the mechanical elastic slide block 30 still enables the safe electromagnetic lock 10 to be freely unlocked, thereby achieving the objective of safety and convenience of operation.

Furthermore, the present invention uses configurational coordination between the second bolt 50 and the steel ball 56 to substantially fix position of the second bolt 50, thereby ensuring the effective prevention of mistakenly locking the safe electromagnetic lock 10, and achieving the objective of increased safety.

In conclusion, from the above detailed description, it can be known that the present invention in overcoming structural shortcomings of prior art has assuredly achieved effectiveness of anticipated objectives, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A safe electromagnetic lock comprising:

a case;

a first keyhole disposed on the case;

a second keyhole disposed on the case;

a first bolt, outward extending from or retracting within a case, controlled by the first keyhole;

an elastic fastener located at an end of the first bolt, the elastic fastener selectively abutting against a protruding edge of the case to disable the first bolt from arbitrarily retracting inward;

an elastic slide block located within the case and slidably disposed on a bottom end of an extended section of the first bolt, wherein the second keyhole is configured to control a sliding movement of the elastic slide block on the bottom end of the extended section, thereby releasing an abutting state of the elastic fastener;

an electromagnetic device positioned within the case at an upper end of the extended section of the first bolt, the electromagnetic device having an induction surface, the electromagnetic device being configured to enable the induction surface of the electromagnetic device to fittingly reciprocate the elastic fastener, the electromagnetic device being connected to a computer using conducting wires, wherein the electromagnetic device is activated to move and release the elastic fastener from abutting the protruding edge when a correct password is input into the computer; and a second bolt positioned within the case in a position above the first bolt, wherein, when locking the safe electromagnetic lock, the first bolt extends into a lockhole and the second bolt retracts within the case, wherein, when unlocking the safe electromagnetic lock, the first bolt retracts within the case and the second bolt extends out from the case, wherein the second bolt is freely retractable to prevent mistakenly locking the safe electromagnetic lock.

2. The safe electromagnetic lock according to claim 1, wherein the elastic fastener is located on an end of the extended section, the elastic fastener being pivotally located on a pivot shaft of an end of the extended section of the first bolt, wherein a spring is disposed between the elastic fastener and the extended section, wherein a front end of the elastic fastener is configured to be forced downward when subjected to elastic tension, thereby causing the elastic fastener to abut against the protruding edge of the case thereby disabling the first bolt from arbitrarily retracting inward and unlocking of the safe electromagnetic lock.

3. The safe electromagnetic lock according to claim 1, wherein the elastic slide block comprises a spring that is disposed between an end surface of the elastic slide block and an inner wall of the case, a contact end is formed on the elastic slide block positioned at another end surface of the bottom end of the extended section of the first bolt, wherein the second keyhole is configured to control the sliding movement of the elastic slide block and push the contact end against the elastic fastener, thereby releasing the abutting state between the elastic fastener and the protruding edge of the case.

4. The safe electromagnetic lock according to claim 1, wherein the second bolt further comprises:

a recess formed in a bottom edge of the second bolt, a first cross bar and a second cross bar located within the recess, a spring fitted on the first cross bar, a protruding mount protruding from a side end surface of the second cross bar and a steel ball positioned between the first bolt and the second bolt within a space between two protruding mounts protruding from a bottom edge of the case, wherein, when unlocking the safe electromagnetic lock and the second bolt extends out from the case, the protruding mount of the second bolt presses and forces down the steel ball, thereby enabling the second bolt to achieve a solid fixation that will not readily retract within the case.

* * * * *